US009960529B2

(12) United States Patent
Maranto et al.

(10) Patent No.: US 9,960,529 B2
(45) Date of Patent: May 1, 2018

(54) COMMUNICATION PLUG WITH IMPROVED CABLE MANAGER

(71) Applicant: Panduit Corp., Tinley Park, IL (US)

(72) Inventors: Keith S. Maranto, Frankfort, IL (US); Satish I. Patel, Roselle, IL (US); Robert E. Fransen, Orland Park, IL (US); Michael G. Dragisic, Jr., New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 0 days. days.

(21) Appl. No.: 15/718,016

(22) Filed: Sep. 28, 2017

(65) Prior Publication Data

US 2018/0019537 A1 Jan. 18, 2018

Related U.S. Application Data

(60) Division of application No. 14/622,425, filed on Feb. 13, 2015, now Pat. No. 9,799,985, which is a continuation of application No. 14/215,658, filed on Mar. 17, 2014, now Pat. No. 8,961,219, which is a continuation of application No. 13/272,649, filed on Oct. 13, 2011, now Pat. No. 8,702,444.

(60) Provisional application No. 61/454,043, filed on Mar. 18, 2011, provisional application No. 61/393,982, filed on Oct. 18, 2010.

(51) Int. Cl.

| | |
|---|---|
| ***H01R 24/00*** | (2011.01) |
| ***H01R 13/58*** | (2006.01) |
| ***H01R 4/24*** | (2018.01) |
| ***H01R 24/64*** | (2011.01) |

(52) U.S. Cl.
CPC ..... *H01R 13/5825* (2013.01); *H01R 4/2404* (2013.01); *H01R 13/5829* (2013.01); *H01R 24/64* (2013.01); *H01R 2201/04* (2013.01)

(58) Field of Classification Search
CPC ..... H01R 23/025; H01R 23/005; H01R 13/6658; H01R 13/5812; H01R 13/5829; H05K 1/0228
USPC ..... 439/676, 460, 418, 467
See application file for complete search history.

(56) References Cited

U.S. PATENT DOCUMENTS

| | | | | |
|---|---|---|---|---|
| 4,516,822 A | | 5/1985 | Wolfel | |
| 5,194,014 A | | 3/1993 | McClune et al. | |
| 5,921,807 A | * | 7/1999 | Okabe | H01R 13/514 439/467 |

(Continued)

FOREIGN PATENT DOCUMENTS

| | | |
|---|---|---|
| CN | 1257331 A | 6/2000 |
| CN | 101313441 | 11/2008 |

(Continued)

*Primary Examiner* — Hien Vu
(74) *Attorney, Agent, or Firm* — Christopher S. Clancy; James H. Williams; Ryan K. Thelen

(57) ABSTRACT

A communication plug is described. The communication plug has a communication cable with a plurality of conductors, a plug housing, and a cable manager partially enclosed within the plug housing. The cable manager has a load bar with a plurality of holes, a first cable management section connected to the load bar via a first hinge, and a second cable management section connected to the load bar via a second hinge. The first and second cable management sections are configured to fold together and partially enclose the cable before the cable manager is inserted into the plug housing.

5 Claims, 19 Drawing Sheets

(56) References Cited

U.S. PATENT DOCUMENTS

| | | | | |
|---|---|---|---|---|
| 6,162,085 | A * | 12/2000 | Chugh | H01R 13/5221 439/275 |
| 6,193,542 | B1 | 2/2001 | Marowsky et al. | |
| 6,368,143 | B1 | 4/2002 | Adams | |
| 6,478,609 | B1 | 11/2002 | Davis et al. | |
| 6,932,641 | B1 | 8/2005 | Liao et al. | |
| 7,001,204 | B1 | 2/2006 | Lin | |
| 7,150,657 | B2 | 12/2006 | Quenneville et al. | |
| 7,175,468 | B1 | 2/2007 | Chang | |
| 7,201,604 | B1 | 4/2007 | Amidon | |
| 7,329,137 | B2 | 2/2008 | Martin et al. | |
| 7,413,464 | B1 | 8/2008 | Chen | |
| 7,484,993 | B2 | 2/2009 | Amidon et al. | |
| 7,559,790 | B2 | 7/2009 | Boeck et al. | |
| 7,572,140 | B2 | 8/2009 | Szelag et al. | |
| 7,604,515 | B2 | 10/2009 | Siemon et al. | |
| 7,722,410 | B2 | 5/2010 | De Dios Martin et al. | |
| 8,070,506 | B2 | 12/2011 | De Dios Martin et al. | |
| 8,092,248 | B2 * | 1/2012 | Van Stiphout | H01R 43/16 439/464 |
| 2003/0139094 | A1 | 7/2003 | Venditti et al. | |
| 2003/0199192 | A1 | 10/2003 | Caveney et al. | |
| 2004/0002252 | A1 | 1/2004 | Hirokawa et al. | |
| 2005/0106929 | A1 | 5/2005 | Meckley et al. | |
| 2007/0178722 | A1 | 8/2007 | Amidon et al. | |
| 2008/0220658 | A1 | 9/2008 | Caveney et al. | |
| 2009/0124116 | A1 | 5/2009 | Patel et al. | |
| 2009/0269973 | A1 | 10/2009 | Caveney et al. | |
| 2010/0048061 | A1 | 2/2010 | Helmig et al. | |
| 2010/0136822 | A1 | 6/2010 | Stiphout et al. | |

FOREIGN PATENT DOCUMENTS

| | | | |
|---|---|---|---|
| CN | 101401265 | A | 4/2009 |
| CN | 101488615 | A | 7/2009 |
| CN | 101752686 | A | 6/2010 |
| DE | 102006039799 | B3 | 11/2007 |
| EP | 0494438 | A2 | 12/1991 |
| EP | 1965473 | A2 | 9/2008 |
| JP | S60-115466 | | 8/1985 |
| JP | S60-216477 | | 10/1985 |
| JP | H08-096890 | A | 4/1996 |
| JP | 2003-045513 | | 2/2003 |
| JP | 2004-031130 | | 1/2004 |
| TW | 240349 | | 2/1995 |
| WO | 0074178 | A1 | 12/2000 |
| WO | WO03/090323 | A2 | 10/2003 |

* cited by examiner

Section A–A

COMMUNICATION PLUG WITH IMPROVED CABLE MANAGER

RELATED SUBJECT MATTER

This application is a divisional of, and claims the benefits of priority to, U.S. application Ser. No. 14/622,425, filed on Feb. 13, 2015 (now allowed), which is a continuation of U.S. application Ser. No. 14/215,658, filed on Mar. 17, 2014 (now U.S. Pat. No. 8,961,219), which is a continuation of U.S. application Ser. No. 13/272,649, filed on Oct. 13, 2011 (now U.S. Pat. No. 8,702,444), which claims the benefits of priority to U.S. Provisional Application No. 61/454,043, filed on Mar. 18, 2011, and U.S. Provisional Application No. 61/393,982, filed on Oct. 18, 2010, the subject matter of which is hereby incorporated by reference in its entirety. U.S. Pat. No. 6,811,445, issued on Nov. 2, 2004, is also incorporated herein by reference in its entirety.

BACKGROUND OF THE INVENTION

In recent years, there has been a motivation to reduce communication cable diameters to reduce cost, improve appearance, increase cable flexibility and conserve valuable raw material resources.

The use of smaller conductor diameters, in particular 26, 28, and 30 AWG conductors for example, can reduce cable diameters and makes it desirable to have tighter conductor management to ensure continuity between the plug insulation piercing contacts (IPC's) and conductors of a communication cord/cable. In addition to the motivation for tighter conductor management, there is a benefit to greater mechanical retention of the cable jacket within the plug assembly. Maintaining this retention can be challenging as cable diameters decrease.

SUMMARY OF THE INVENTION

The present invention comprises, in one form thereof, a communication plug with a plug housing and a cable manager at least partially within the plug housing. The cable manager has a load bar which has a plurality of through holes. The cable manager further includes a first cable management section connected to the load bar via a first hinge, and a second cable management section connected to the load bar via a second hinge.

The present invention comprises, in another form thereof, a communication system including an item of communication equipment, and a communication plug connected to the communication equipment. The communication plug includes a plug housing and a cable manager at least partially with the plug housing. The cable manager has a load bar which has a plurality of through holes. The cable manager further includes a first cable management section connected to the load bar via a first hinge, and a second cable management section connected to the load bar via a second hinge.

The present invention comprises, in yet another form thereof, a method of manufacturing a communication cord including a twisted pair communication cable and at least one communication plug. The method includes the steps of: inserting the communication cable within a cable manager of the communication plug; linking a first cable management section of the cable manager to a second cable management section of the cable manager, and compressing the cable manager within a housing of the communication plug.

The present invention comprises, in yet another form thereof, a communication plug with a plug housing, and a cable manager at least partially within the plug housing. The cable manager includes a bridge section hingedly connected to a first cable management section and/or a second cable management section. The first cable management section and/or the second cable management section has a cable trough with a cable axis. The first cable management section has at least one first retention rib, and the second cable management section has at least one second retention rib opposed to the first retention rib(s).

The present invention comprises, in yet another form thereof, a method of manufacturing a communication cord having a twisted pair communication cable and at least one communication plug. The method includes the steps of: molding a cable manager of the communication plug in an open position; folding the cable manager around an end of the communication cable; and inserting the cable manager and the communication cable into a housing of the communication plug.

DETAILED DESCRIPTION OF THE ILLUSTRATED EMBODIMENTS

The present invention is a plug that is suitable for use with a communication cable with 26-30 American Wire Gauge (AWG) conductors of the twisted pairs in the communication cable. Although the present invention is particularly shown in a CAT5E application it can be adapted to CAT6, CAT6A, and other applications. The present invention can also be adapted to larger and smaller conductor wire gauges.

Figure 1:
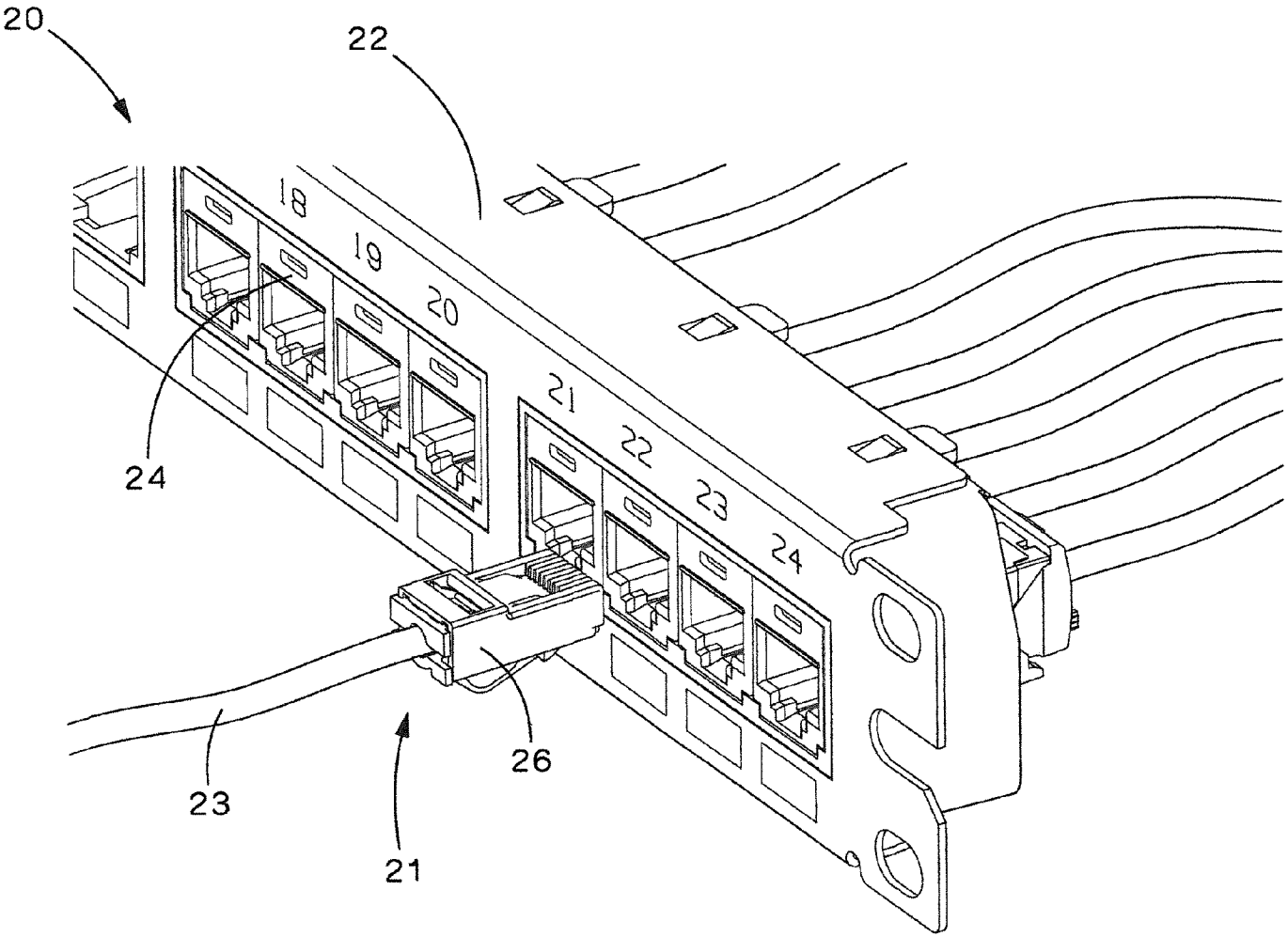
FIG. 1 is a perspective view of a communication system.

The present invention can be used in a communication system 20 as shown in FIG. 1. Communication system 20 can include at least one communication cord 21 connected to equipment 22. Equipment 22 is illustrated as a patch panel in FIG. 1, but the equipment can be passive equipment or active equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. Communication system 20 can further include cabinets, racks, cable management and overhead routing systems, and other such equipment.

Communication cord 21 can include unshielded twisted pair (UTP) cable 23 and more particularly a CAT5E cable for this application. However, the present invention can be applied to and/or implemented in a variety of communications cables shielded or unshielded, any of CAT5E, CAT6, CAT6A, CAT7, CAT7A and other twisted pair Ethernet cable, as well as other types of cables. Cord 21 can have its other end (not shown) terminated directly into similar equipment 22, or alternatively, can be terminated in a variety of plugs 26 or jack modules 24 such as RJ45 type, jack module cassettes, and many other connector types, or combinations thereof. Further, cords 21 can be processed into looms, or bundles, of cables, and additionally can be processed into preterminated looms.

Cords 21 can be used in a variety of structured cabling applications including patch cords, zone cords, backbone cabling, and horizontal cabling, although the present invention is not limited to such applications. In general, the present invention can be used in military, industrial, telecommunications, computer, data communications, marine and other cabling applications.

Figure 2:
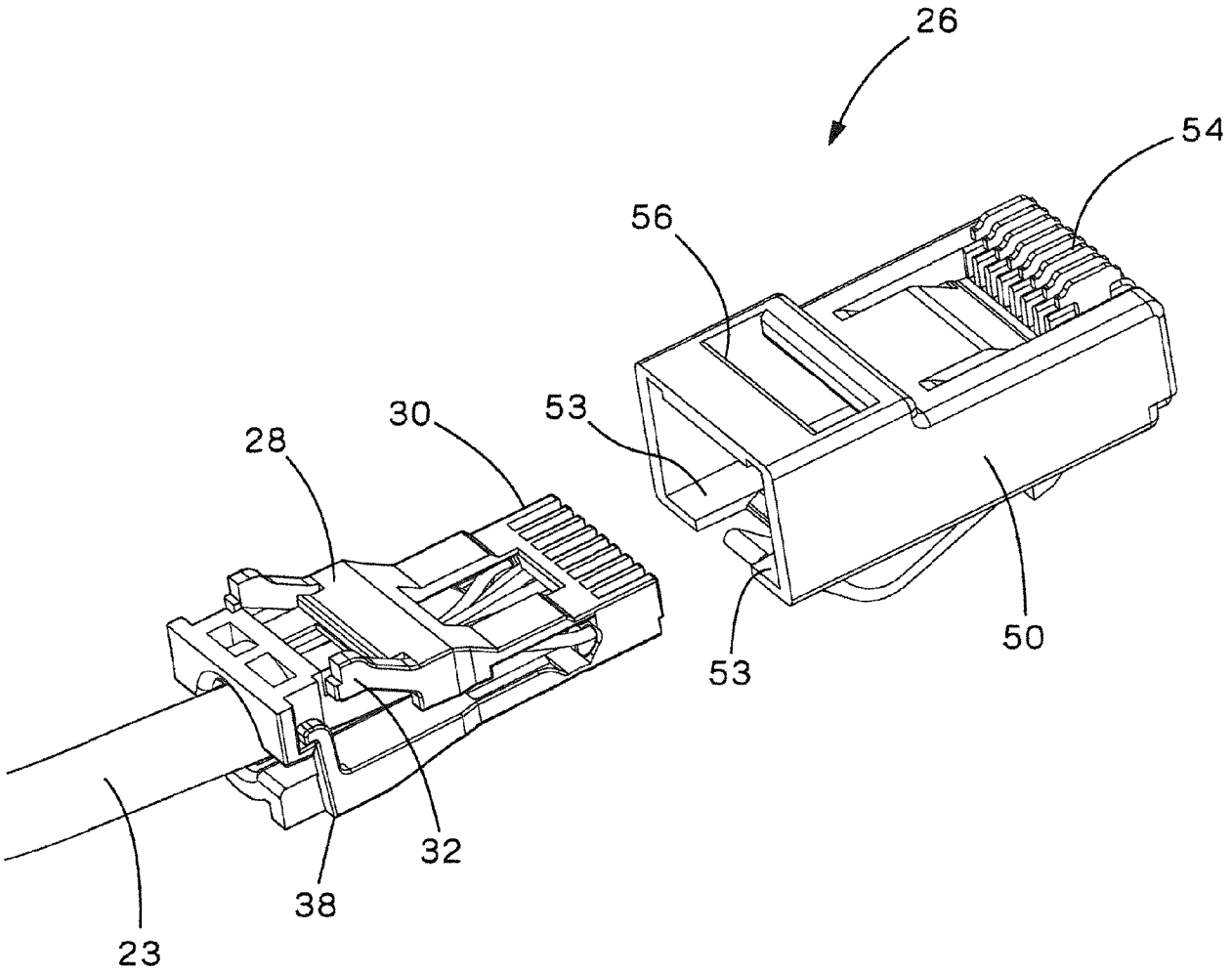
FIG. 2 is a partially-exploded perspective view of a first embodiment of the present invention communication plug.
Figure 3:
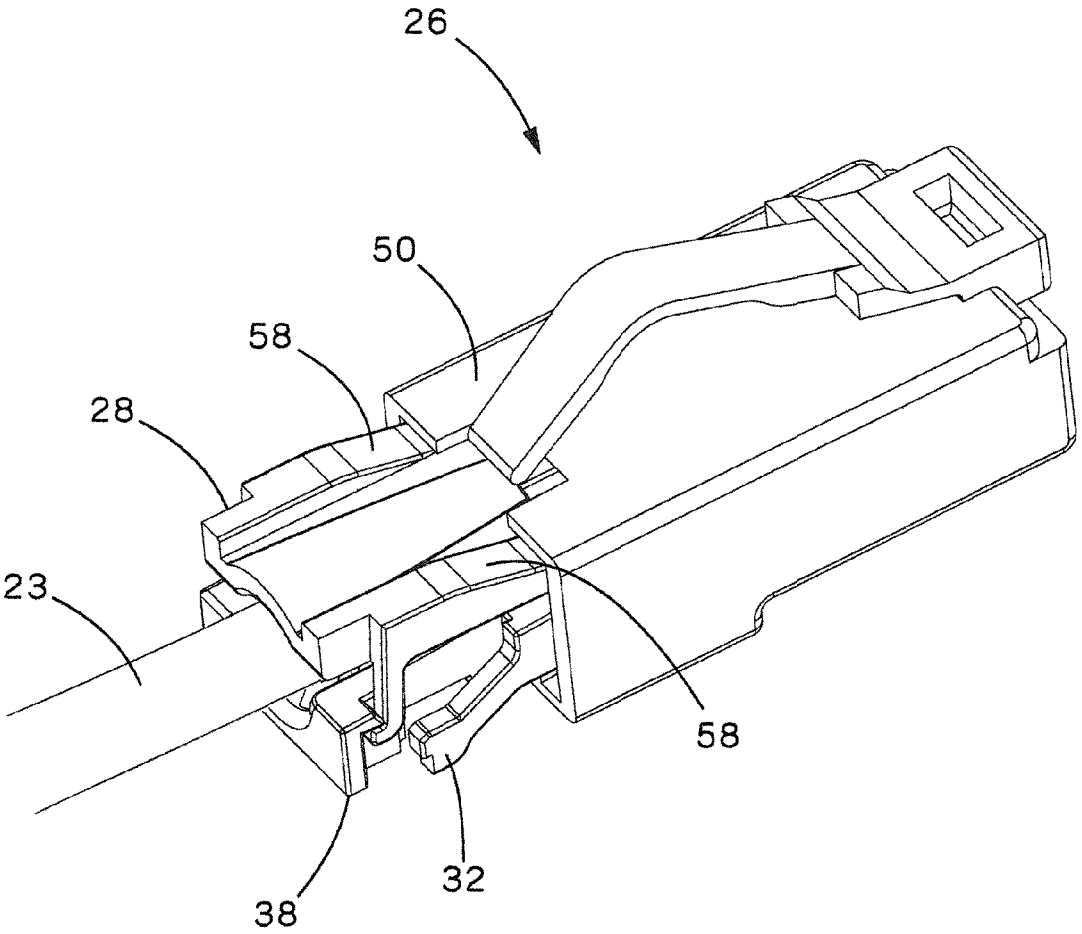
FIG. 3 is a perspective view of the communication plug of FIG. 2 with the cable and cable manager partially inserted into the housing.

Referring now to FIGS. 2 and 3 (FIG. 3 is rotated 180° with respect to FIG. 2) plug assembly 26 contains a cable manager 28 with an integrated load bar 30, and plug housing 50. Cable retention features are contained within cable manager 28. The integrated load bar 30 has conductor holes 46 (see FIGS. 4-5A) with diameters that accommodate the 26-30 AWG insulated conductors 44 (shown in FIGS. 5A and 5B) of the cable 23.

The cable manager 28 includes features that allow for easier arrangement of cable conductors 44 and greater cable retention without the need of a separate strain relief collar and cable boot. The cable manager 28 is preferably a molded cable manager, and is preferably formed in an "open" configuration (FIG. 4) allowing simple threading of the eight small conductors 44 shown in FIGS. 5A and 5B into their appropriate load bar holes 46. This direct access to the integrated load bar or bridge 30 is accomplished by molding the cable manager 28 with hinges 34, providing the ability to collapse two cable management sections 10 and 11 of the cable manager 28 onto cable 23 as shown in FIG. 2 for final insertion into the modular plug housing 50. Plug housing 50 and plug contacts (within comb section of plug housing 50) are the same or similar to that described in U.S. Pat. No. 6,811,445.

Figure 4:
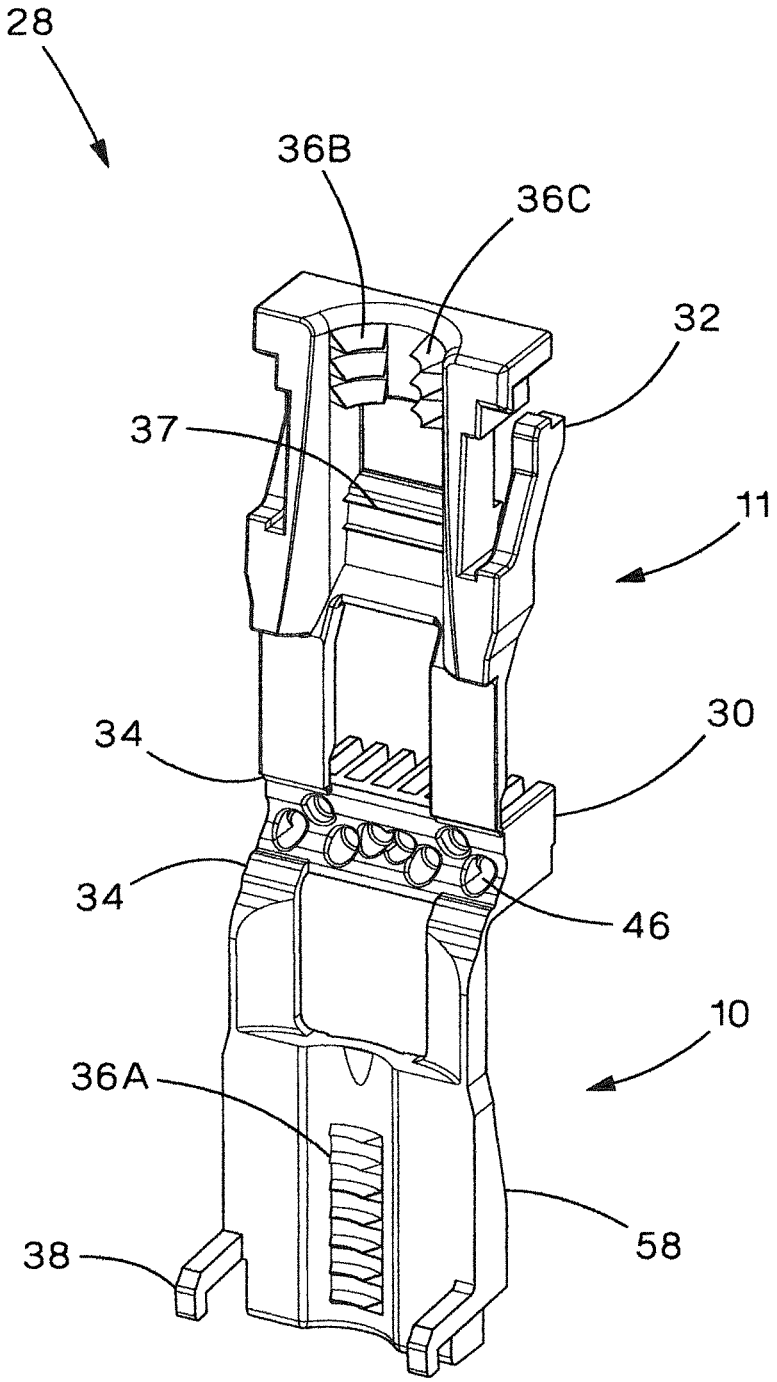
FIG. 4 is a perspective view of the cable manager of the communication plug of FIG. 2 with the first and second cable management sections folded away from each other.
Figure 5B:
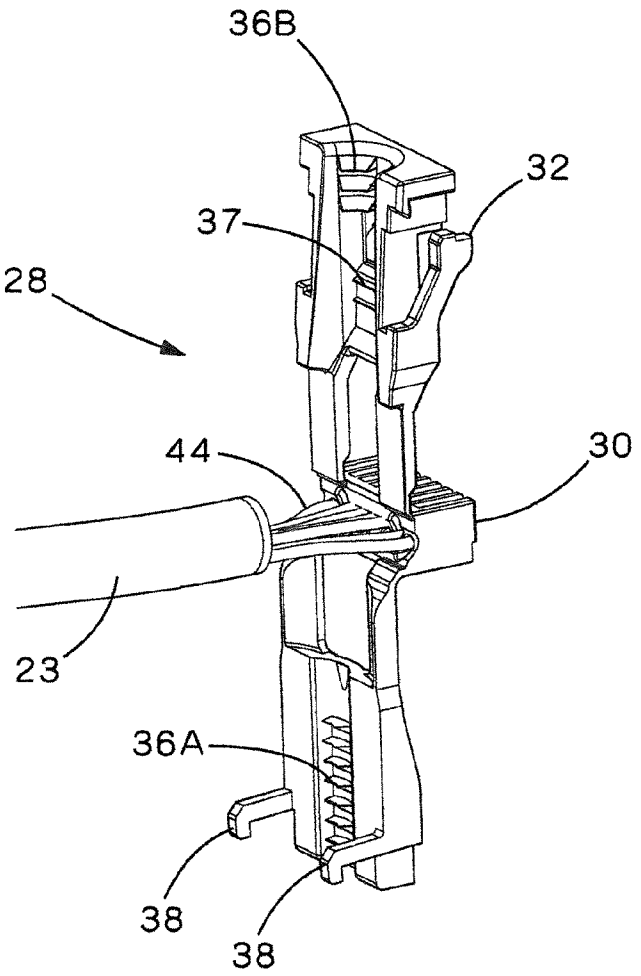
FIGS. 5*a* and 5*b* are perspective views of the cable manager of the communication plug of FIG. 2 with the conductors of a cable being inserted into the load bar and the first and second cable management sections being folded away from each other.
Figure 5A:
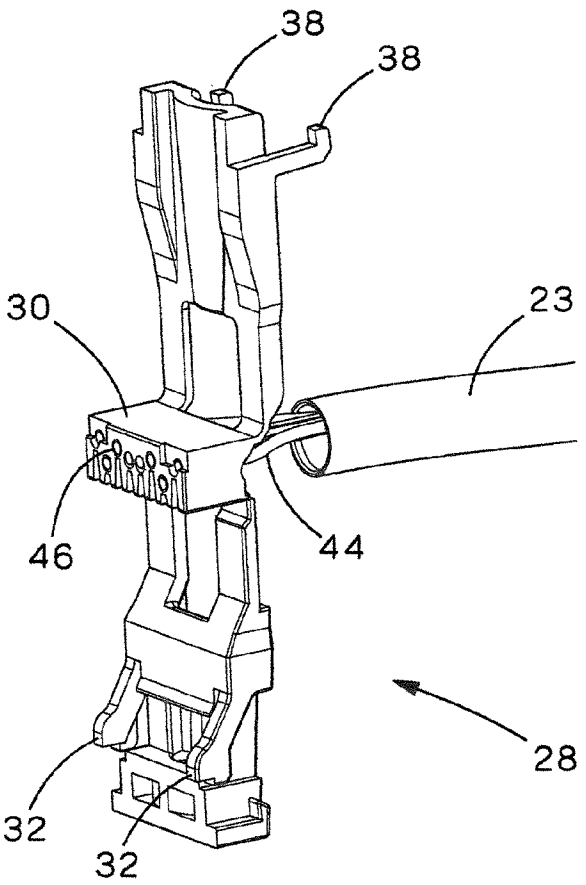

Cable retention is accomplished by the interaction between the cable jacket and the cable manager 28. Preferably, the cable manager contains ribs that compress the cable jacket, forming a strong interference fit and trapping the cable jacket between opposing ribs. The ribs are arranged in an array with a center that is, at least approximately, concentric with a cable axis of the cable manager. In one embodiment, ribs 36A-36C, as shown in FIG. 4, provided on both cable management sections of the cable manager 28, engage the jacket of the cable 23 when the cable manager 28 sections are folded over along the hinges 34. Temporary latches 38 engage as shown in FIGS. 2 and 3, preventing the cable 23 from backing out of the cable manager 28 during assembly of the plug assembly 26. In one embodiment, as shown, the ribs 36A are provided on a first cable management section 10 of the cable manager 28, and the ribs/barbs 36B and 36C are provided on a second cable management section 11 of the cable manager 28. Preferably, the ribs are arranged such that the centerlines of the ribs are spaced approximately circumferentially around the cable 23 when the cable management sections 10 and 11 of the cable manager 28 are collapsed around the cable 23. The concentric ribs allow cable clamping while maintaining an approximately circular cross-section of the cable, and also maintains the relative positions of the conductors within the cable. Although ribs 36A-36C do depress into the cable 23 jacket, the relative roundness of the cable can be generally maintained, along with the relative symmetry of the conductor pair arrangement.

Final compression between the jacket of the cable 23 and the cable manager 28 is achieved when the cable manager 28 is inserted into the plug housing 50. FIG. 3 shows a partial insertion of the cable manager 28 and cable 23 into the plug housing 50. The cable manager 28 contains deflection ramps 58. As the molded cable manager 28 and cable 23 are inserted into the plug housing 50 the deflection ramps 58 engage the walls 53 of the plug housing 50. This interaction forces the cable manager 28 to further close, compressing, and slightly deforming the cable 23, and creating sufficient holding of the cable 23 between the ribs 36A-C. The rib height is designed to depress into a depth of the cable jacket thickness but, coincidentally, also prevent a significant disturbance to the pair twist and spacing of the twisted wire pairs in the cable. The rib height can depend on the overall cable diameter, jacket material, and/or thickness of the jacket, for examples. Cable manager 28 can include additional rib features 37, although rib features 37 tend not to be as effective as concentric ribs 36A-36C.

Figure 6A:
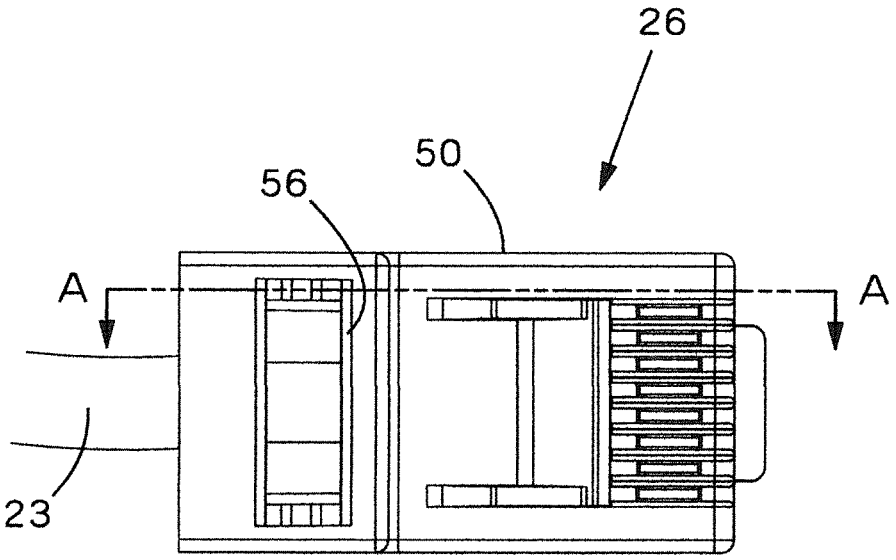
FIG. 6*a* is a bottom view of the communication plug of FIG. 2
Figure 6B:
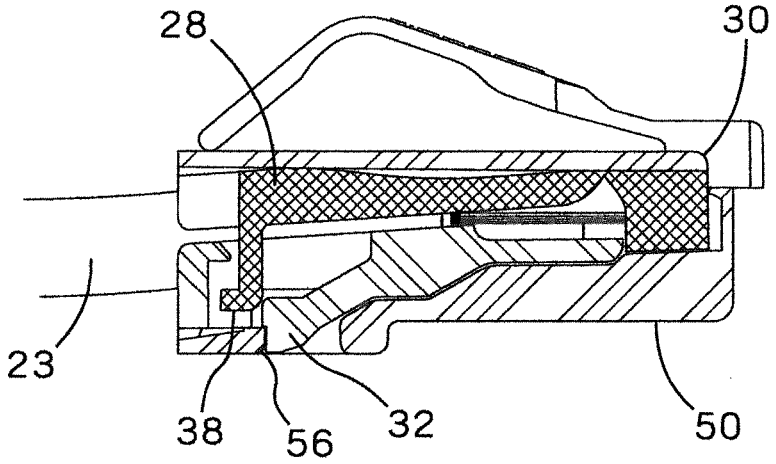
FIG. 6*b* is a cross-sectional view of the communication plug of FIG. 2 taken along line A-A of FIG. 6*a*.

FIG. 6*a* is a bottom view of a plug according to one embodiment of the present invention, and FIG. 6*b* is a cross-sectional view along line A-A of FIG. 6*a*. Referring to FIG. 6*b*, to prevent the cable 23 and cable manager 28 from backing out of plug housing 50, cable manager latches 32 engage the plug housing 50 at lip 56 when cable manager 28 is fully seated within plug housing 50.

Figure 7:
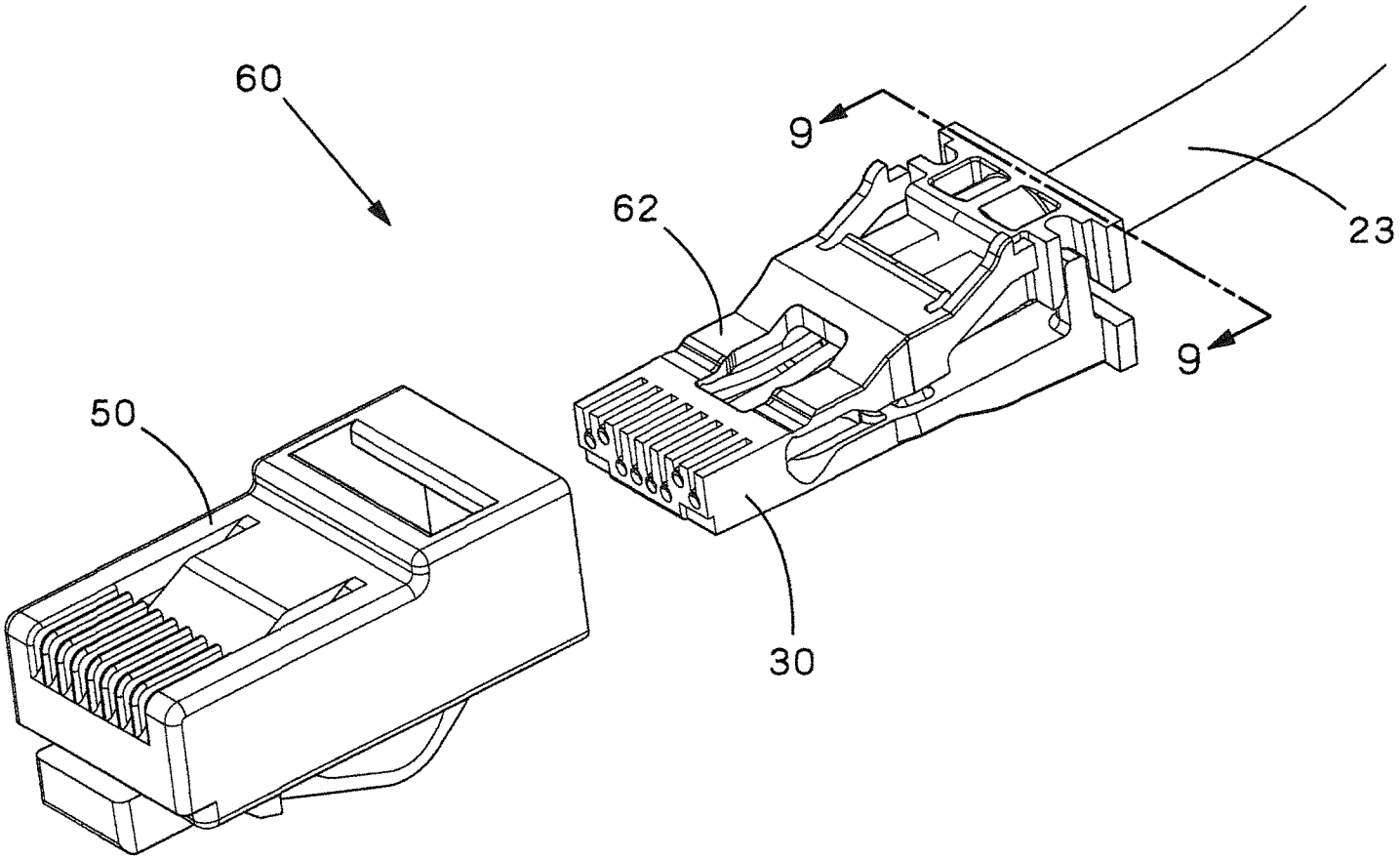
FIG. 7 is a partially-exploded perspective view of a second embodiment of the present invention communication plug with an alternate cable manager.
Figure 8B:
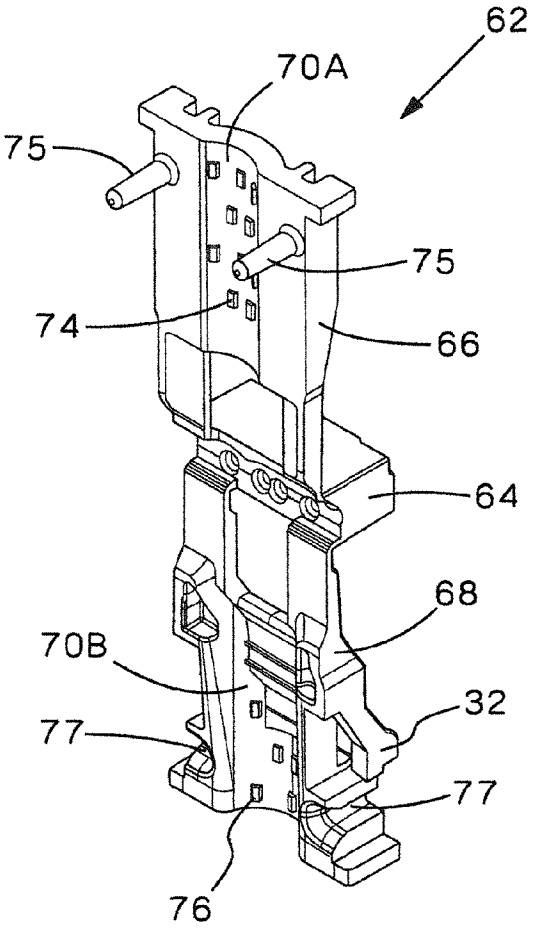
FIGS. 8*a* and 8*b* are perspective views of the cable manger of the communication plug of FIG. 7.
Figure 8A:
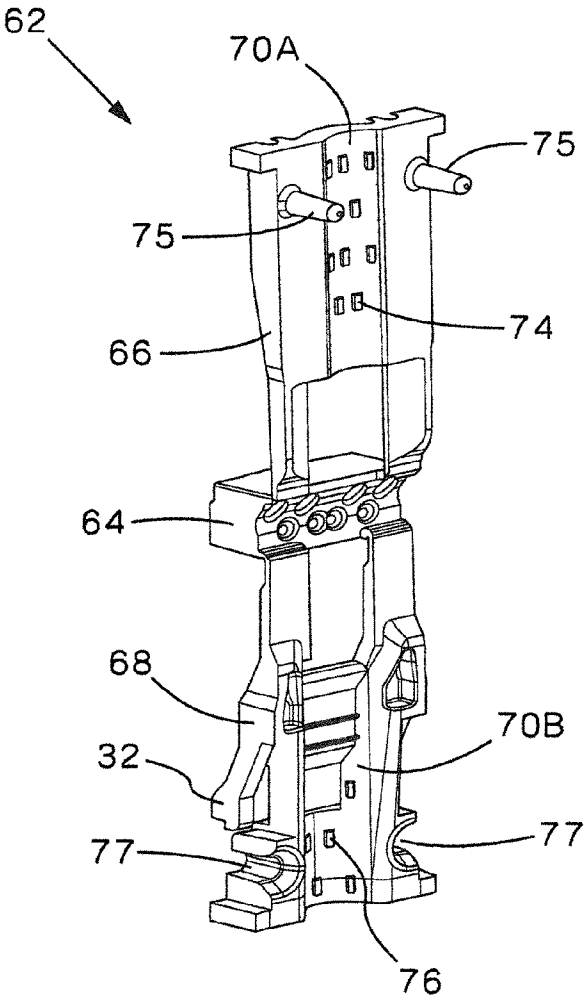
Figure 9:
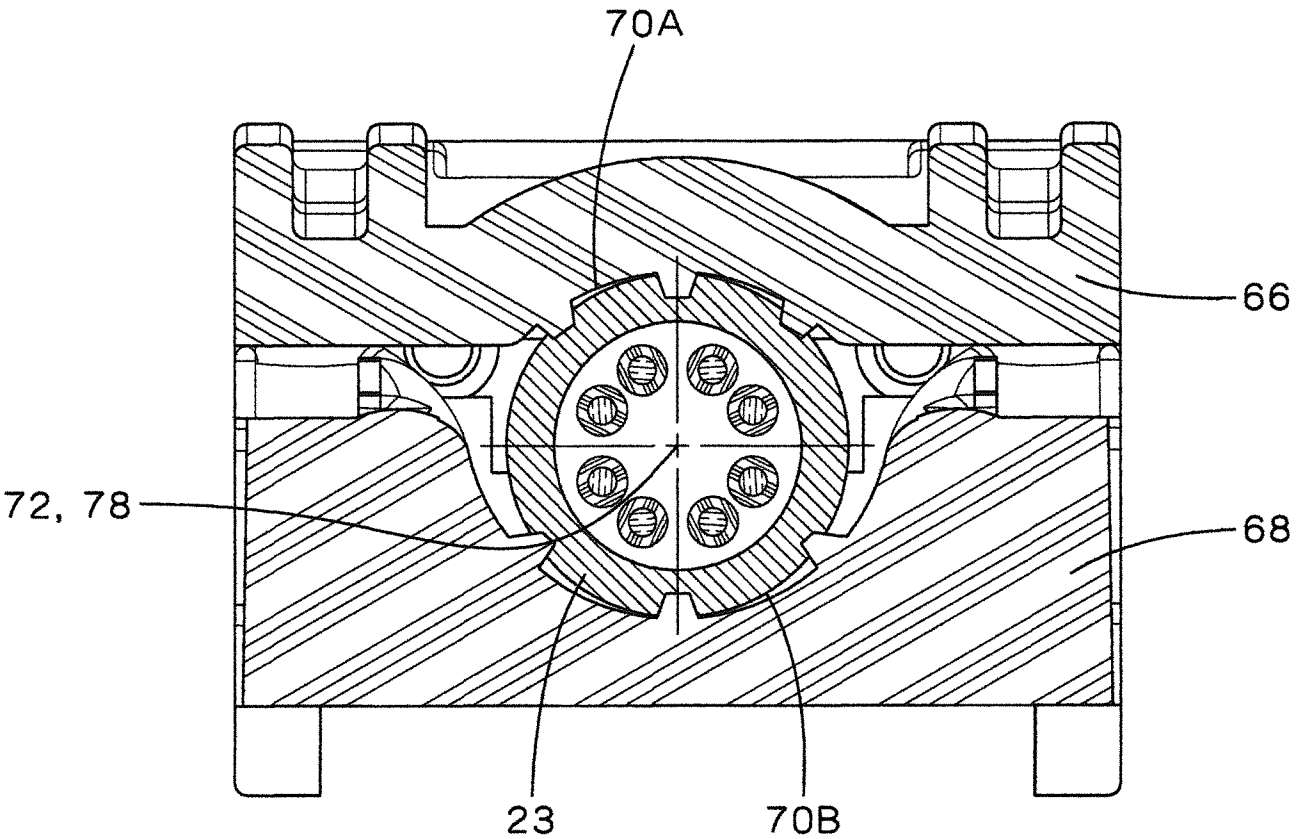
FIG. 9 is a cross-sectional view of the communication plug of FIG. 7 taken along line 9-9.
Figure 10:
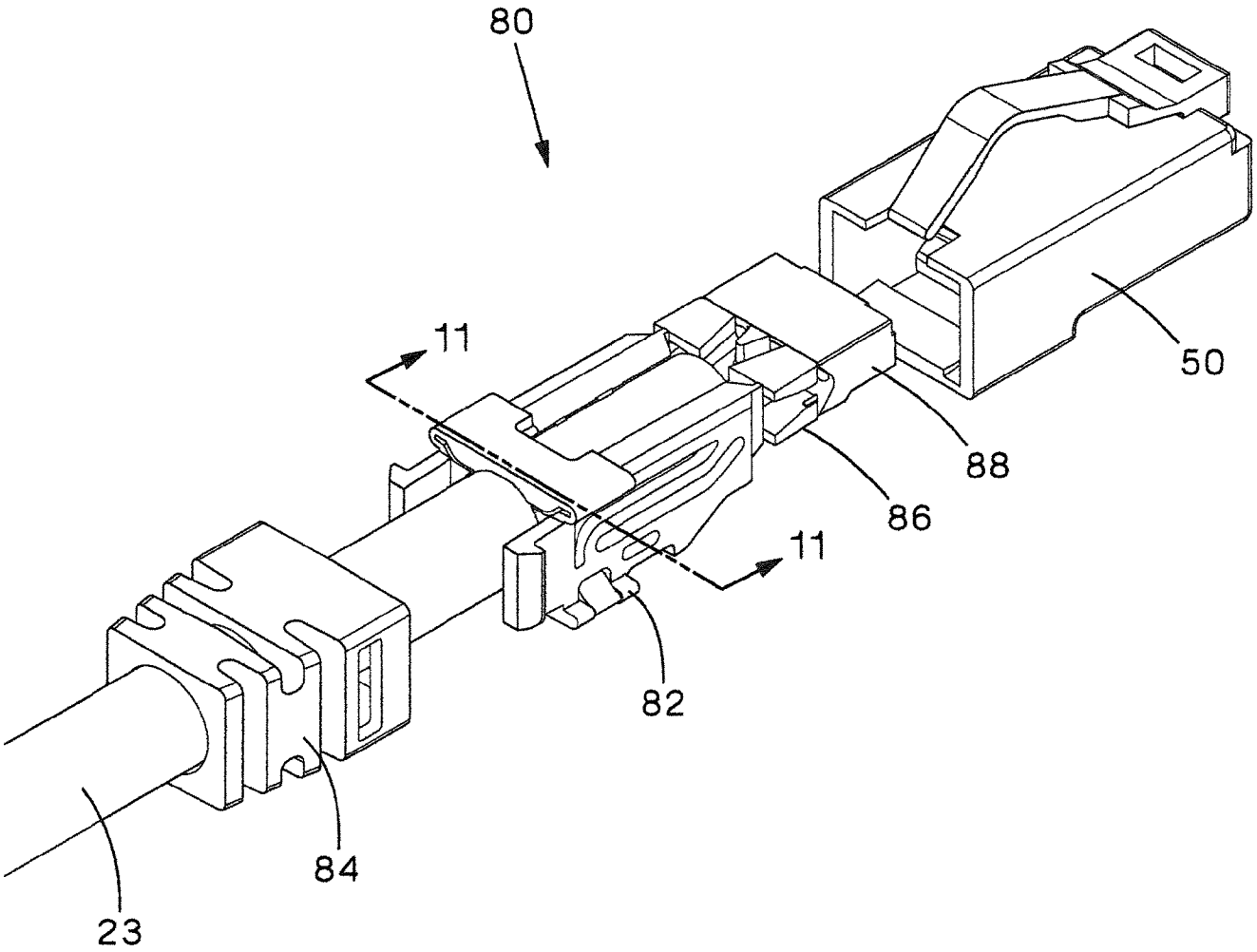
FIG. 10 is a perspective view of a third embodiment of the present invention communication plug.
Figure 11:
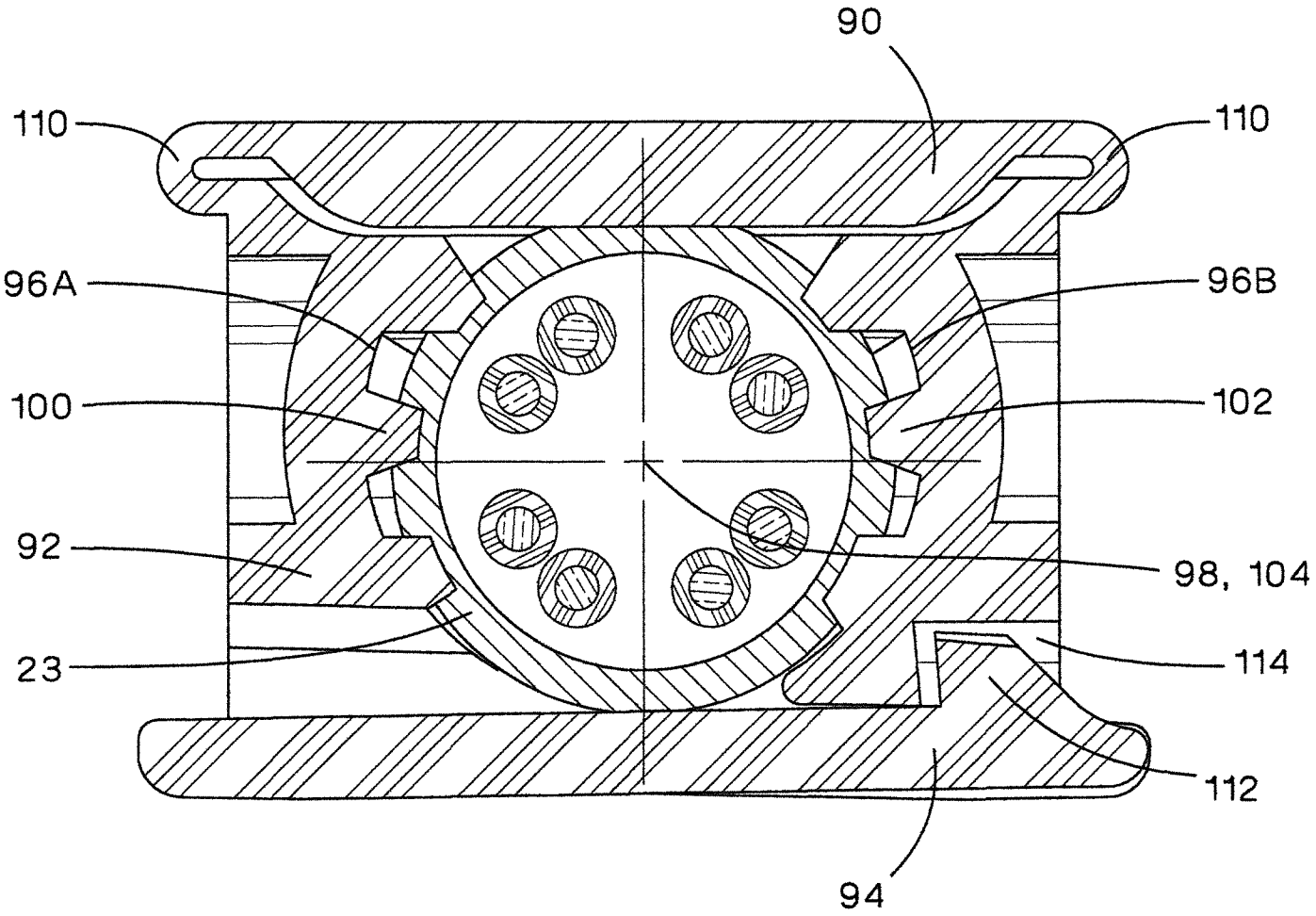
FIG. 11 is a cross-sectional view of the communication plug of claim 10 taken along line 11-11.

In the embodiment of FIGS. 7-9, plug 60 includes plug housing 50 with a cable manager 62 at least partially within plug housing 50. As with cable manager 28 of plug 26, cable manager 62 includes a load bar/bridge section 64 (integrated load bar 30 comprises the bridge/load bar in cable manager 28) hingedly connected to a first cable management section 66 and a second cable management section 68. Also similarly to cable manager 28, the first cable management section 66 and the second cable management section 68 include cable troughs 70A, 70B with a cable axis 72, First cable management section 66 has at least one first retention rib 74, and second cable management section 68 has at least one second retention rib 76 opposed to ribs 74. Ribs/barbs 74, 76 are arranged in an array on cable manager 62, more particularly the array of ribs resides at least in part on cable troughs 70A, 70B, which array (collection of ribs 74, 76 in cable troughs 70A, 70B) has a center 78 (FIG. 9) which is approximately concentric with a cable axis 72 of cable manager 62.

Ribs 74, 76 are a frusto-pyramidal shape having a rectangular base at the corresponding cable trough 70A or 70B. Unlike the strain relief collar described in U.S. Pat. No. 6,811,445 which is generally molded in a closed position and requires pulling a cable through the strain relief collar, cable managers 28, 62 are molded in an open position and then folded around cable 23. Such molding and folding of the cable manager provides more degrees of freedom when designing the ribs as the cable will not need to be pulled through the cable manager against the ribs. Consequently, effective ribs can be designed according to the present invention in a more varied way, and placed in the cable trough in a more varied fashion, including discontinuities in the longitudinal extent of the ribs, while still using a straight pull die for the molding of the cable managers. A straight pull die reduces the capital expense necessary to mold the plug. Sufficient pull test strain relief can be achieved for the plug assembly/cord, particularly with small diameter cables, while at the same time maintaining manufacturing efficiencies and relatively low costs for the plug assemblies/cords of the present invention. Plugs, according to the present invention, can sufficiently hold a small diameter cable without disturbing the twisted pairs in the cable in such a way that electrical performance is significantly reduced. Cable manager 62 can include alignment pins 75 and alignment guides 77 in respective sections 66 and 68.

In another embodiment, according to the present invention, plug assembly 80 (FIGS. 10-13), includes cable manager/strain relief collar 82, boot 84, conductor divider 86, load bar 88 and plug housing 50, connected to cable 28. Boot 84, conductor divider 86, load bar 88, plug contacts, and plug housing 50 can be the same as, or similar to, that described in U.S. Pat. No. 6,811,445.

Cable manager/strain relief collar 82 includes a bridge section 90 hingedly connected to a first cable management section 92 and a second cable management section 94. First cable management section 92 and a second cable management section 94 include cable troughs 96A, 96B, respectively, with a cable axis 98. First cable management section 92 has at least one first retention rib 100, and second cable management section 94 has at least one second retention rib 102. Ribs 100, 102 are arranged in an array on cable manager 82, more particularly the array of ribs resides at least in part on cable troughs 96A, 96B, which array (collection of ribs 100, 102 in cable troughs 96A, 96B) has a center 104 (FIG. 11) which is approximately coincident with a cable axis 98 of cable manager 82.

Relief slot 106 is located above latch 108 and allows for deflection of latch 108 during assembly to plug housing 50. The clearance provided by relief slot 106 keeps material stresses within acceptable limits and creates a robust, repeatable interface between strain relief collar 82 and plug housing 50 such that engagement remains during cyclic or vibrational loading.

Figure 12:
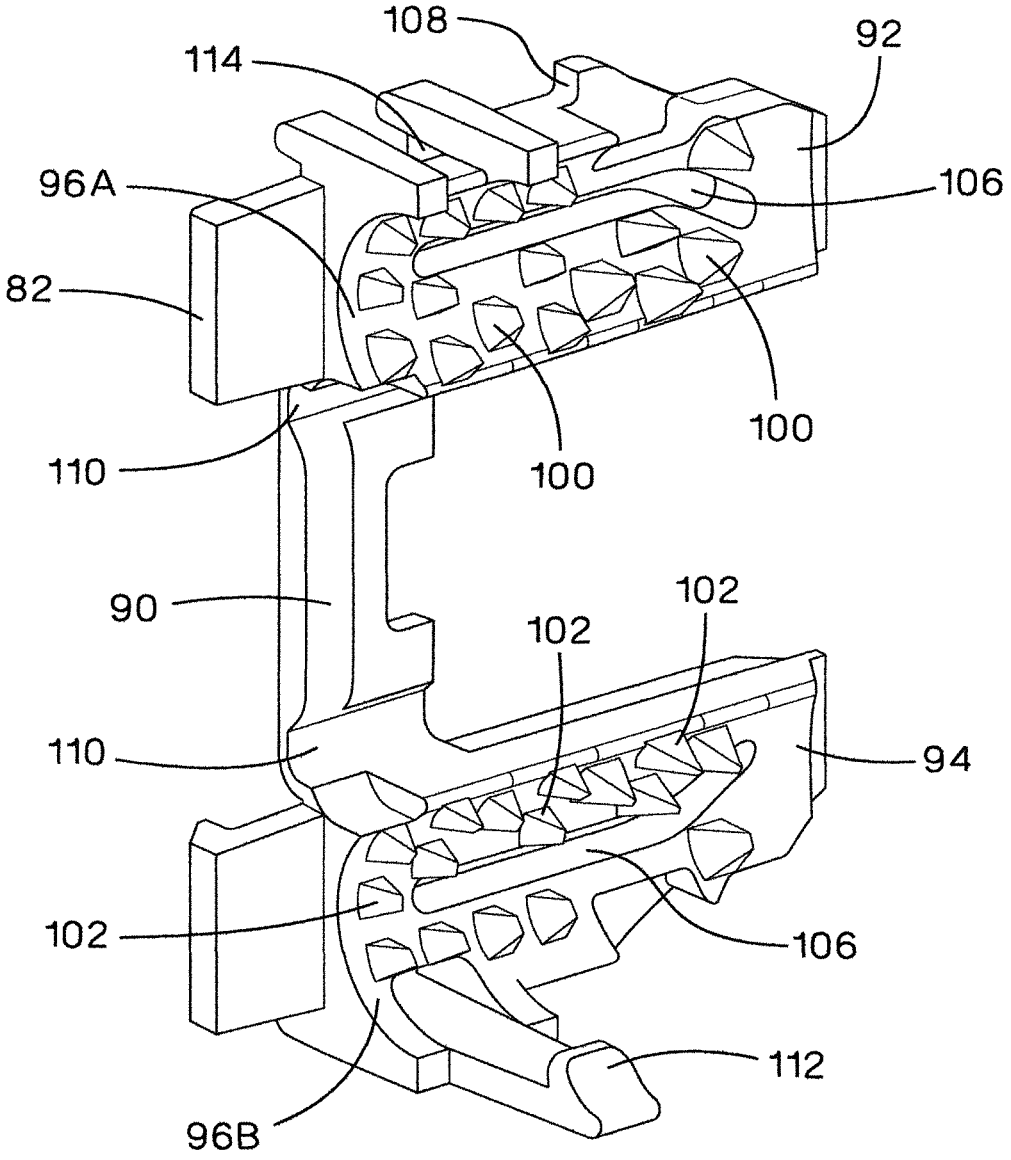
FIG. 12 is a perspective view of the cable manager/strain relief collar of the communication plug of FIG. 10 with the first and second cable management sections folded away from each other.
Figure 13:
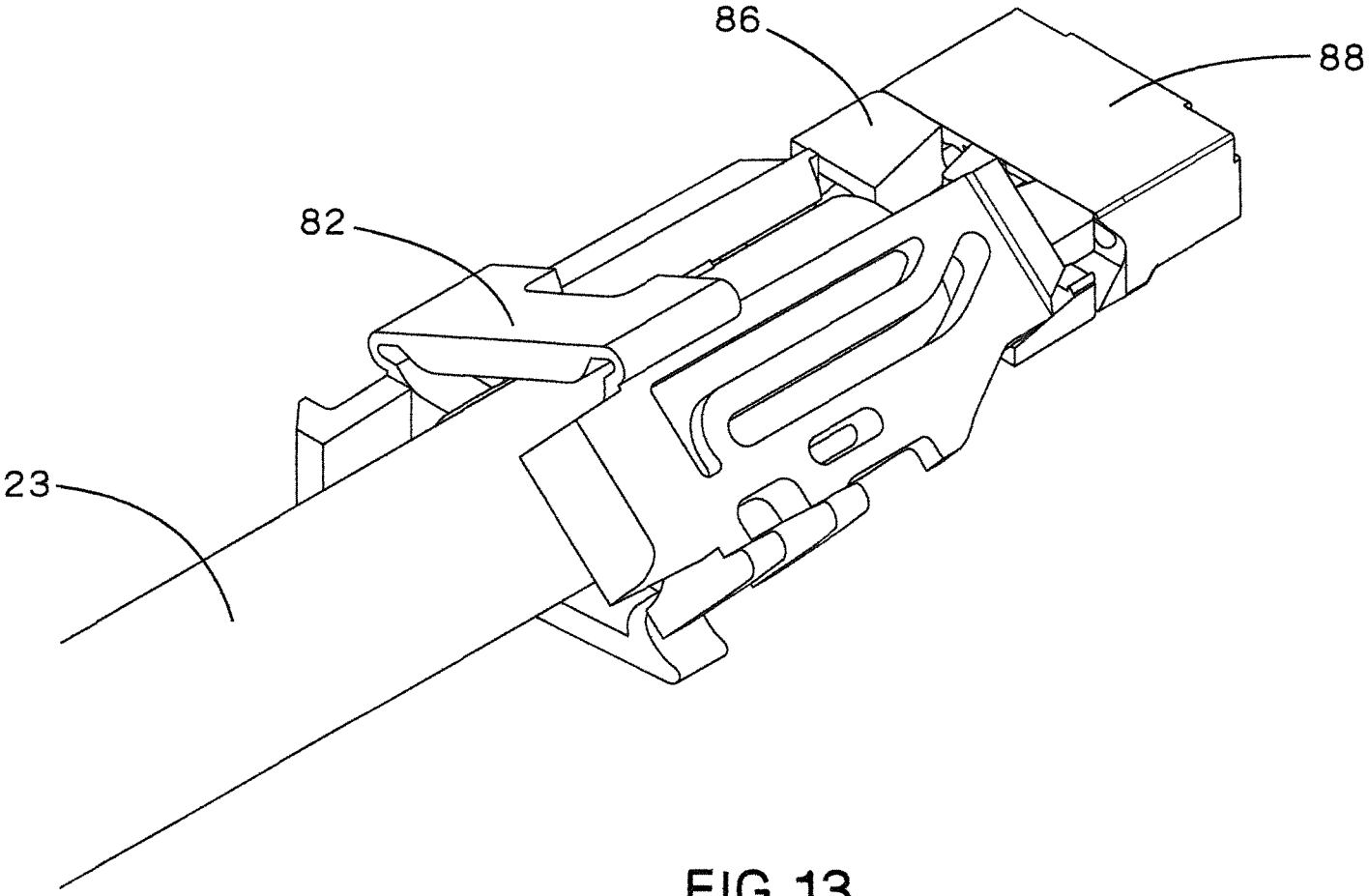
FIG. 13 is a perspective view of the cable manger/strain relief collar of the communication plug of FIG. 12 with the first and second cable management sections folded towards each other and enclosing the cable.
Figure 14:
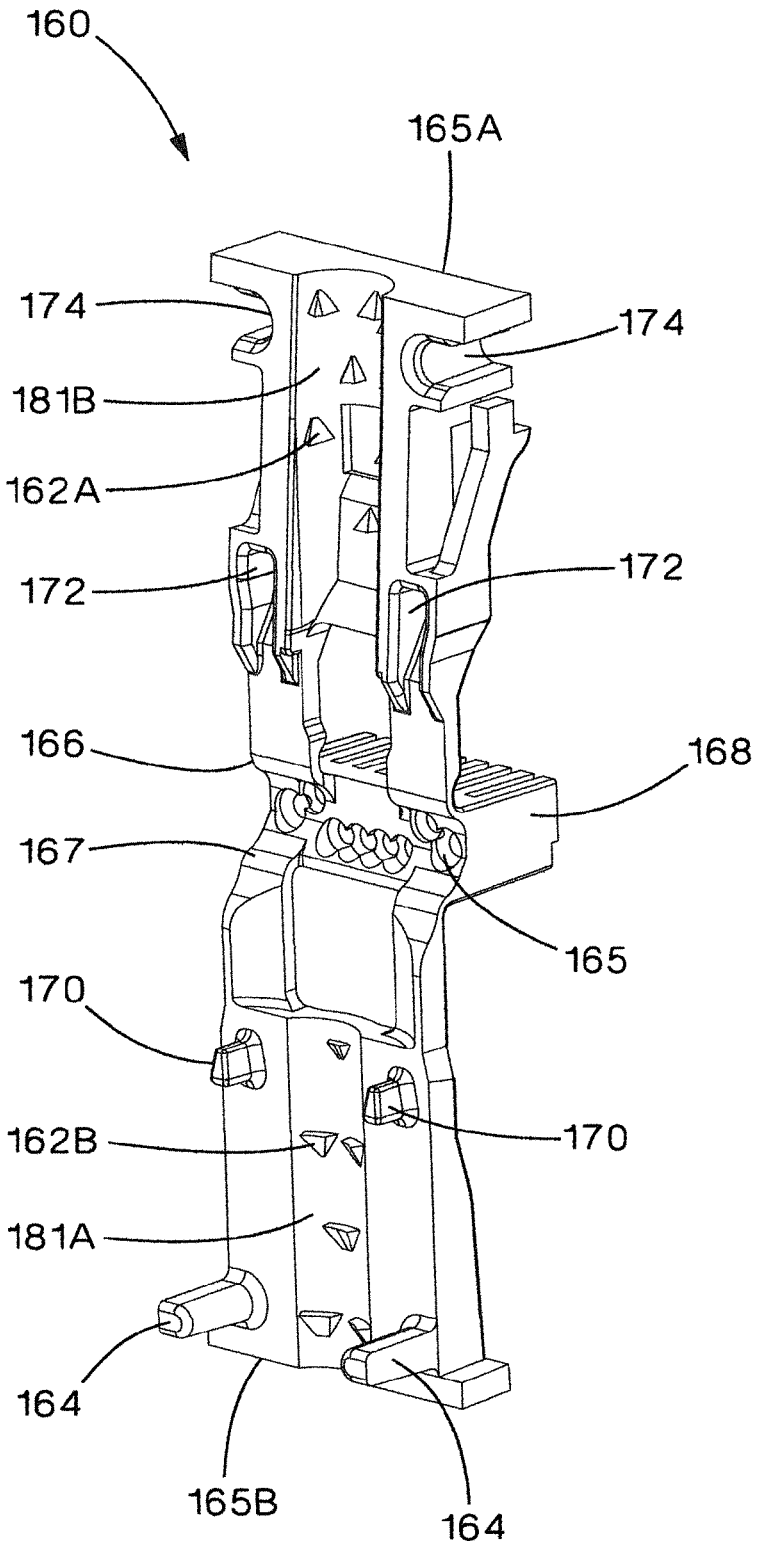
FIG. 14 is a perspective view of a cable manager of a fourth embodiment of the present invention communication plug.
Figure 15:
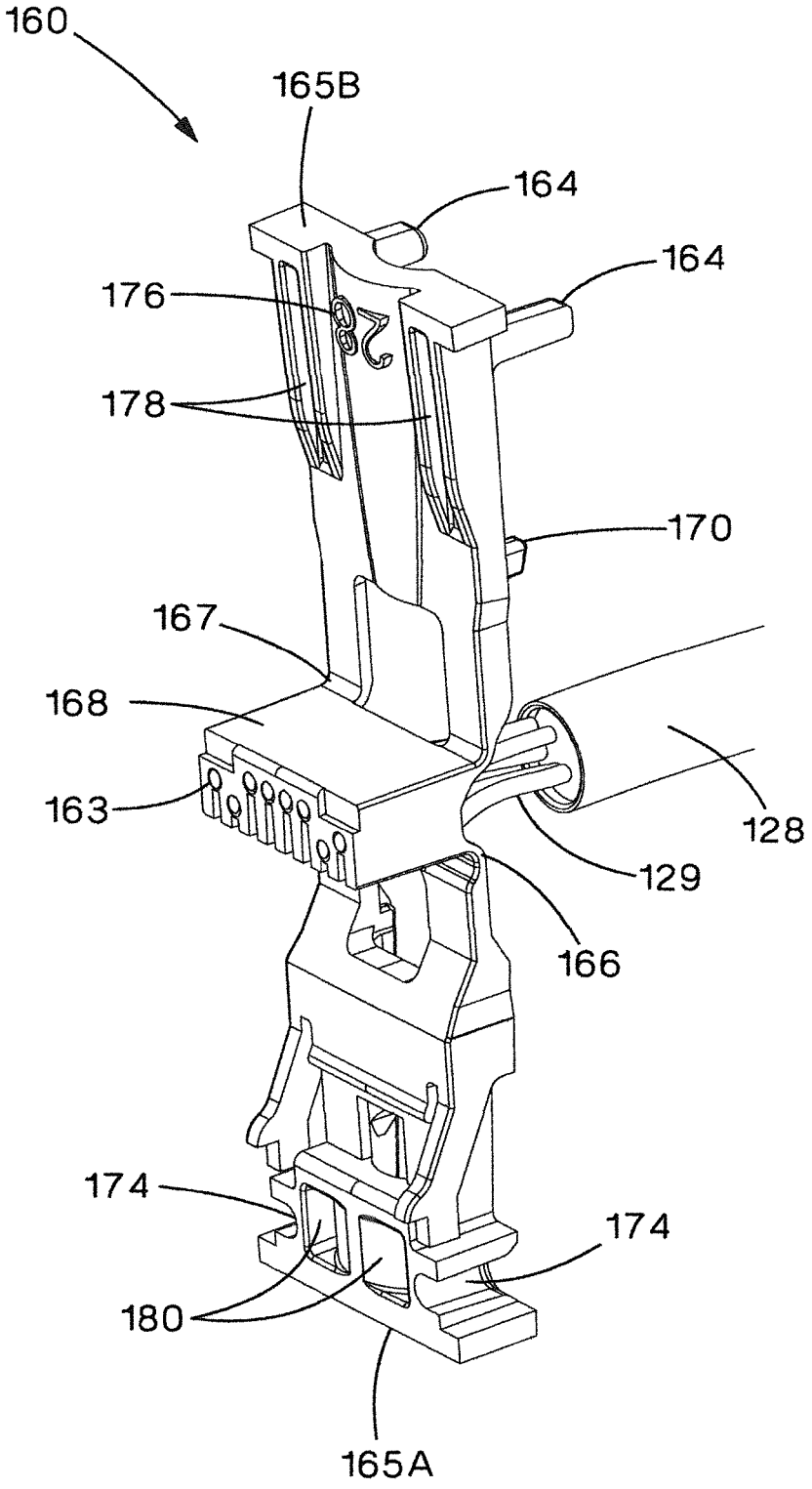
FIG. 15 is a perspective view of the cable manger of FIG. 14 with the conductors of a cable being inserted into the load bar.
Figure 16:
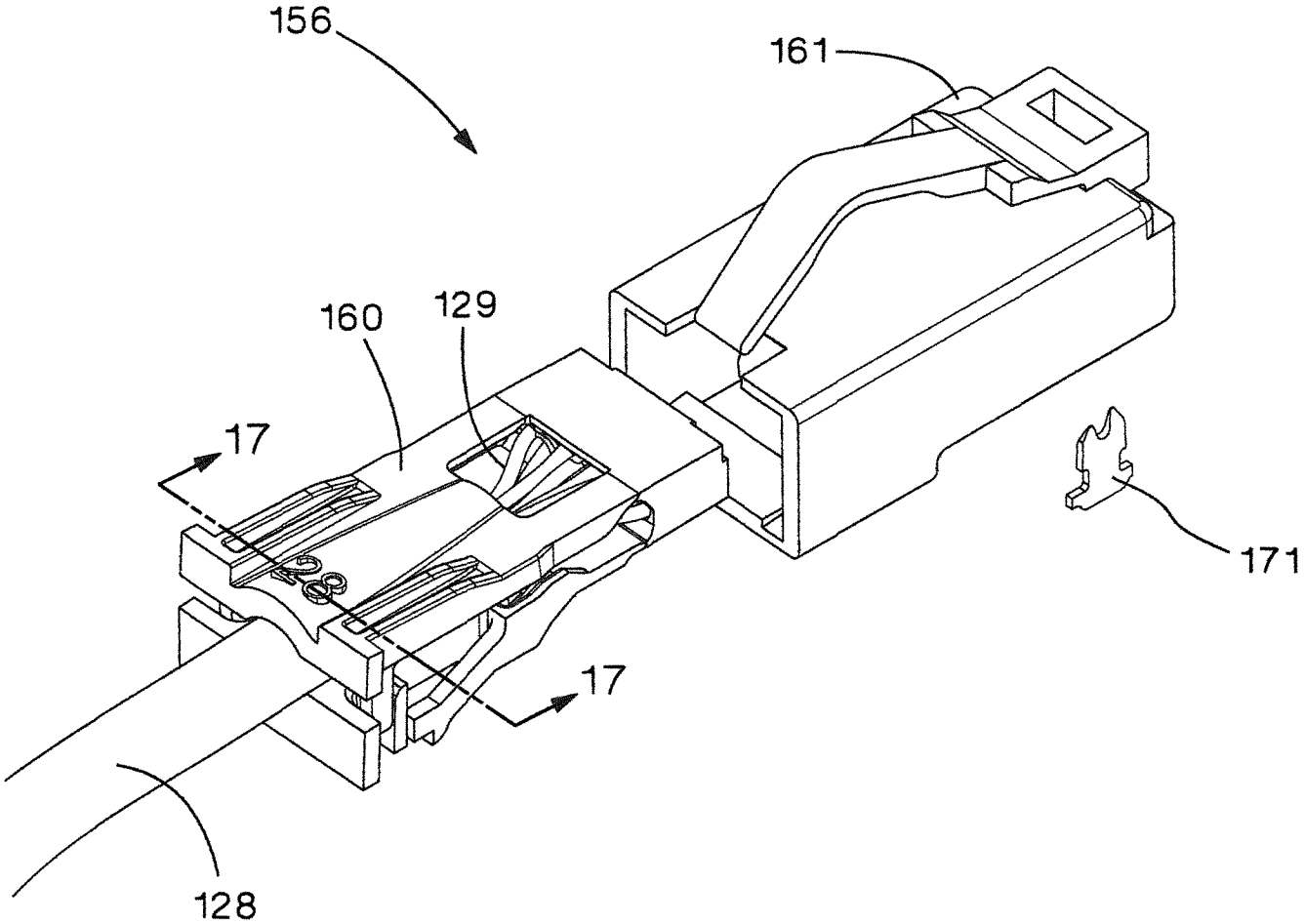
FIG. 16 is a perspective view of a communication plug using the cable manger of FIG. 14.

Strain relief collar 82 can be constructed of a polymer using an injection molding process. FIG. 12 shows strain relief collar 82 in an open, as-molded, state; and FIG. 13 illustrates cable manager 82 in a partially assembled state. As with cable managers 28 and 62, orienting strain collar 82 as shown allows strain relief barbs/ribs 100, 102 and relief slot 106, to align parallel to the molding draw direction. This allows strain relief collar 82 to be molded using a straight pull mold, which is significantly less expensive than incorporating complicated side actions or lifters in the manufacturing mold. Plastic hinges 110 allow strain relief collar 82 to be folded as required for plug assembly 80. Strain relief collar 82 is held closed when locating clamp latch 112 engages pocket 114. After assembly of strain relief collar 82 onto cable 23, plug housing 50 and boot 84 slide to engage and compress strain relief collar 82. Plug contacts are crimped to pierce the cable conductors, completing plug assembly 80.

Because strain relief collar 82 wraps around cable 28 and does not slide onto the cable, ribs/barbs 100, 102 can be relatively tall in interference depth. Taller barbs 100, 102, and a plurality of barbs 100, 102, made possible by molding cable manager 82 in open orientation maximizes engagement to cable 23 and effectively mitigates risk of cable 23 sliding free from strain relief collar 82 due to pulling forces exerted onto cable 23.

Any of plugs 26, 60 and/or 82 can be used in communication system 20.

Figure 17:
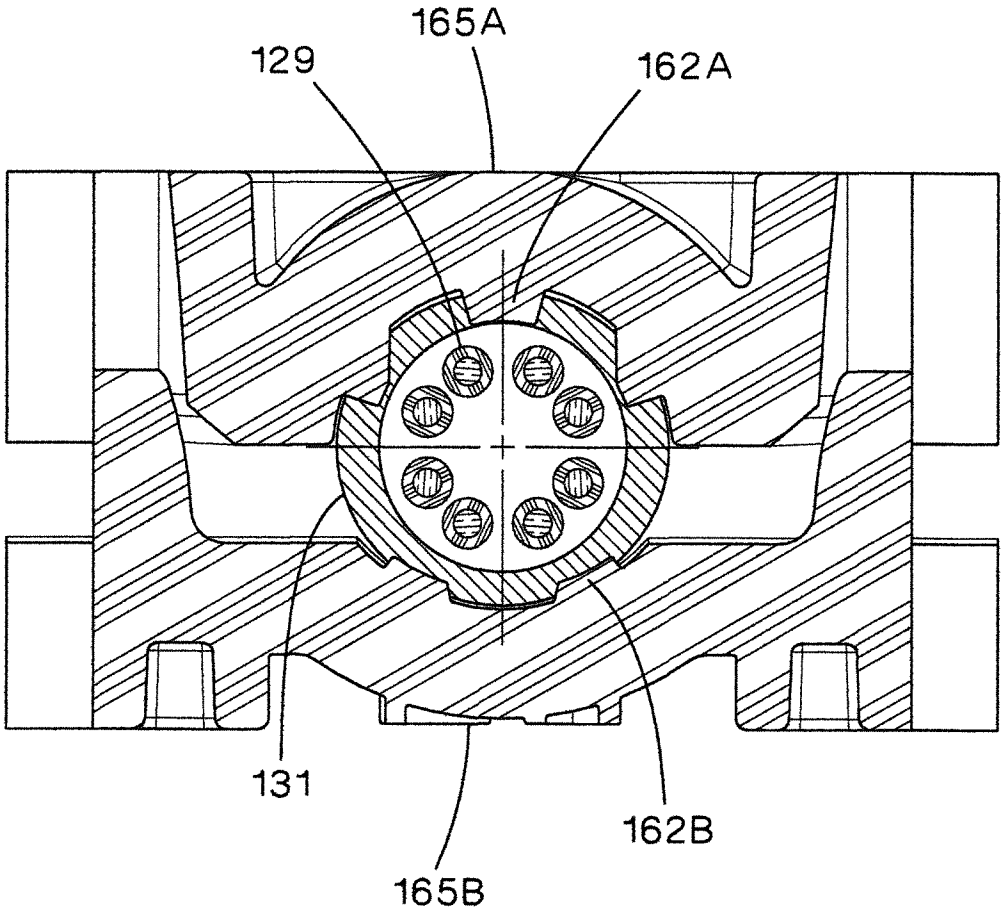
FIG. 17 is a cross-sectional view of the communication plug of FIG. 16 taken along line 17-17.

In another embodiment according to the present invention (FIGS. 14-17) plug 156 includes cable manager 160 with an integrated load bar 168, housing 161, and eight insulation piercing contacts 171. The integrated load bar 168 has conductor holes 163 to accommodate the smaller diameter conductors 129 of the 28 AWG cable 128. Cable retention features, or radial barbs, 162A and 162B, protruding from the radial cable pockets or troughs 181A and 181B allow the cable manager 160, when folded about hinges 166 and 167 (hinges are on both sides of the cable manager), to firmly grip cable 128. Staggering the radial barbs 162A and 162B along the radial cable pockets 181A and 181B allow the cable jacket 131 to displace around the radial barbs 162A and 162B as shown in FIG. 17. Cable 128 is compressed increasing the cable retention and preventing the cable 128 from being pulled out of the plug 156.

To eliminate any functional plug failure in the event of a hinge 166 or 167 fracture after final assembly, interlocking alignment features 164 and 174 are used to align and minimize movement between the two halves 165A and 165B. Pocket features 172 are included to minimize sink marks forming during molding and double as mating pockets for additional alignment features 170. A tapered hole feature 165 allows for easier alignment of conductors 129 into load bar holes 163. Recessed pockets 172, 178 and 180 decrease mold sink issues by ensuring a more equal wall thickness throughout the part. Cable manager 160 includes a molded identification symbol 176 to ensure proper use of the correct cable manager 160 with the corresponding gauge cable.

Figure 18:
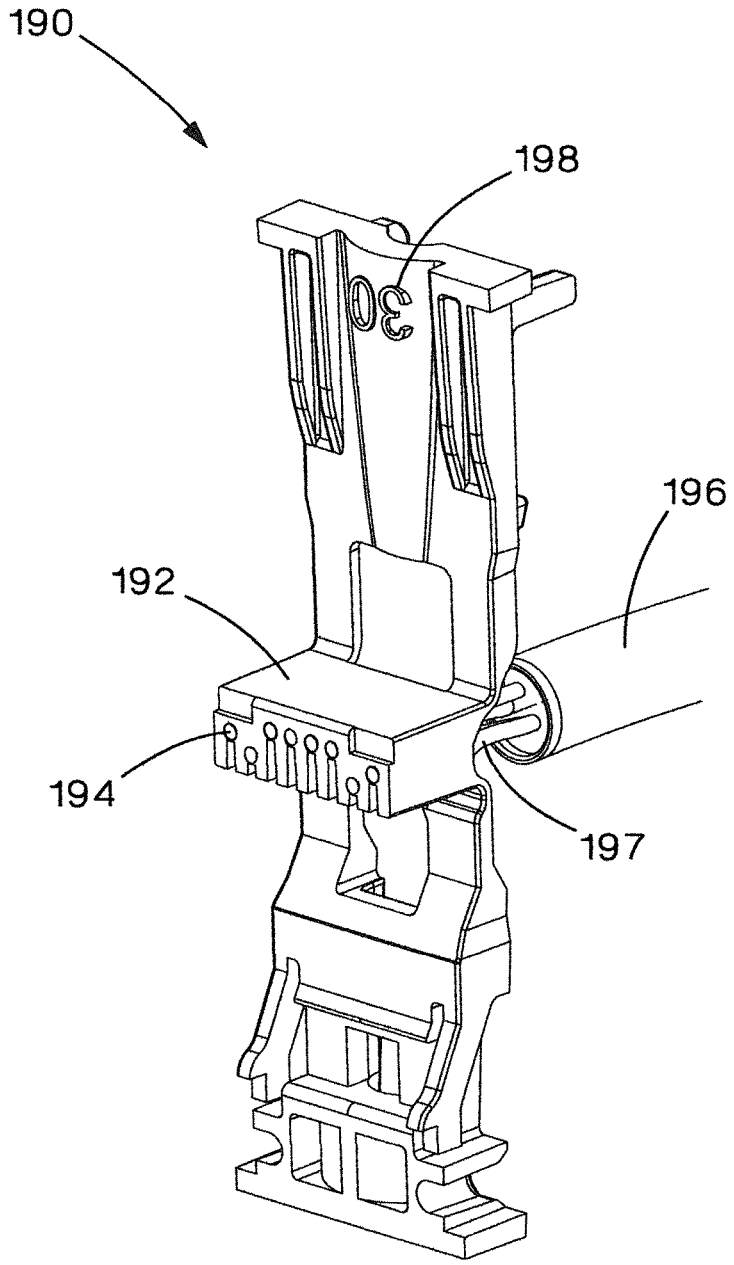
FIG. 18 is perspective view of a cable and cable manager of a fifth embodiment of the present invention communication plug with the conductors of the cable being inserted into the load bar of the cable manager.
Figure 19:
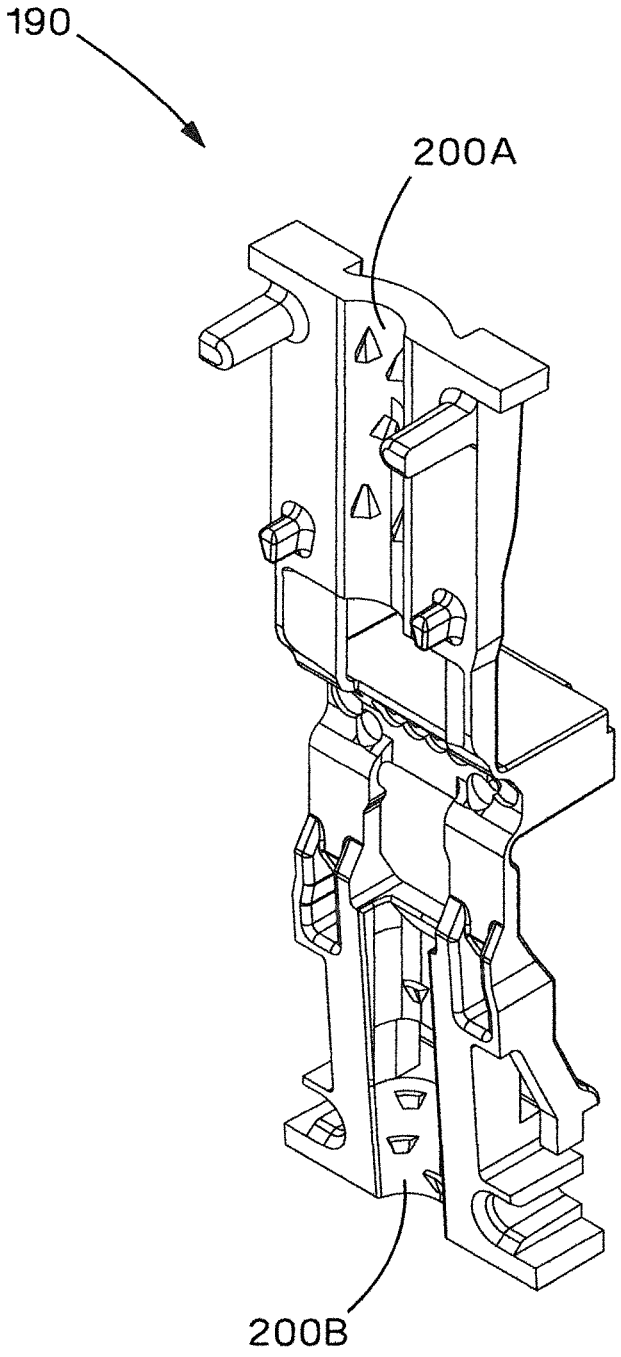
FIG. 19 is a perspective view of the cable manager of FIG. 18 with the first and second cable management sections folded away from each other.

In another embodiment according to the present invention, a 30 AWG version of cable manager 190 is shown in FIGS. 18 and 19. Cable manager 190 functions essentially identically to cable manger 160 but with the exception of smaller conductor holes 194 within load bar 192 and a smaller cable clamping diameter 200A and 200B. Cable manager 190 includes a molded identification symbol 198 to ensure proper use by the customer of the correct cable manager with the corresponding 30 gauge cable. Feature changes described above allow for a smaller 30 AWG cable 196 and conductors 197.

Any of plugs 26, 60, 82 and/or 156 can be used in communication system 20.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. A communication plug for use with a communication cable having a plurality of conductors, said communication plug comprising:

a plug housing having a longitudinal length and a cavity; and a cable manager positioned at least partially within said cavity, said cable manager including a first cable management section, a second cable management section, and a bridge section connecting said first cable management section and said second cable management section, said first cable management section and said second cable management section being configured to fold together and at least partially enclose said communication cable, said first cable management section being hingedly attached to said bridge section about a hinge joint axis, said hinge joint axis being substantially parallel to said longitudinal length of said plug housing;

wherein at least one of said first and said second cable management sections has a housing latch and a relief slot, said housing latch being configured to engage a portion of said plug housing when said cable manager is inserted into said cavity to help prevent said cable manager from backing out of said plug housing, and said relief slot being configured to allow for deflection of said housing latch when said cable manger is inserted into said plug housing.

2. The communication plug of claim 1, wherein said second cable management section is hingedly attached to said bridge section about a second hinge joint axis, said second hinge joint axis being substantially parallel to said longitudinal length of said plug housing.

3. The communication plug of claim 1 further comprising a load bar positioned within said cavity, said load bar including a plurality of conductor holes, each of said conductor holes positioned substantially parallel to said longitudinal length of said plug housing and shaped to receive one of said conductors.

4. The communication plug of claim 3 further comprising a conductor divider, said conductor divider being positioned within said cavity and between said cable manager and said load bar, said conductor divider helping direct said conductors into said conductor holes.

5. A communication cord comprising:

a communication cable having a plurality of conductors; and a communication plug connected to said communication cable, said communication plug including:

a plug housing having a longitudinal length and a cavity; and a cable manager positioned at least partially within said cavity, said cable manager including a first cable management section, a second cable management section, and a bridge section connecting said first cable management section and said second cable management section, said first cable management section and said second cable management section being configured to fold together and at least partially enclose said communication cable, said first cable management section being hingedly attached to said bridge section about a hinge joint axis, said hinge joint axis being substantially parallel to said longitudinal length of said plug housing;

wherein at least one of said first and said second cable management sections has a housing latch and a relief slot, said housing latch being configured to engage a portion of said plug housing when said cable manager is inserted into said cavity to help prevent said cable manager from backing out of said plug housing, and said relief slot being configured to allow for deflection of said housing latch when said cable manger is inserted into said plug housing.

* * * * *